US007827710B2

(12) United States Patent
Kershner et al.

(10) Patent No.: US 7,827,710 B2
(45) **Date of Patent: *Nov. 9, 2010**

(54) CARD FOR RETAINING ITEMS THEREIN

(75) Inventors: Patrick W. Kershner, Overland Park, KS (US); Christine E. Gehring-Scheff, Overland, KS (US); Victoria L. Watts, Olathe, KS (US); Thomas A. Wallen, Merriam, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 736 days.

This patent is subject to a terminal disclaimer.

(21) Appl. No.: 11/684,422

(22) Filed: Mar. 9, 2007

(65) Prior Publication Data

US 2007/0144044 A1 Jun. 28, 2007

Related U.S. Application Data

(63) Continuation of application No. 10/653,040, filed on Aug. 29, 2003, now Pat. No. 7,204,048.

(51) Int. Cl.
*G09F 1/00* (2006.01)

(52) U.S. Cl. ..... 40/124.06

(58) Field of Classification Search ..... 40/124.06, 40/124.09, 124.11, 124.12, 124.19, 124.4, 40/359, 777

See application file for complete search history.

(56) References Cited

U.S. PATENT DOCUMENTS 618,449 A 1/1899 Warner
861,748 A 7/1907 Mitchell
861,749 A 7/1907 Mitchell
1,058,830 A 4/1913 Witkowski
1,106,058 A 8/1914 Rand
1,141,172 A 6/1915 Clark
2,298,601 A 10/1942 Tremblett
2,417,982 A 3/1947 Histed
2,504,277 A 4/1950 Otterson (Continued)

OTHER PUBLICATIONS

Gingerbread Man Holding Gift Card believed to be publicly distributed before Aug. 29, 2003 (1 page).

(Continued)

*Primary Examiner*—S. Joseph Morano
*Assistant Examiner*—Robert J McCarry, Jr.
(74) *Attorney, Agent, or Firm*—Fish & Richardson P.C.

(57) ABSTRACT

A card may include a generally planar panel and a plurality of opposing retaining members disposed on the panel. The plurality of opposing retaining members may be arranged to retain a substantially rectangular transaction card having a first longitudinal axis in a first orientation with respect to the panel and to retain a substantially rectangular paper gift having a second longitudinal axis in a second orientation with respect to the panel, so that the orientation of the first longitudinal axis is substantially transverse to the second orientation of the second longitudinal axis. The paper gift may be, for example, paper monetary currency, a paper bank check, or a paper gift certificate. The transaction card may be, for example, a debit card, a credit card, a gift card, a prepaid phone card, a card containing a merchandise credit usable at a retail establishment.

8 Claims, 5 Drawing Sheets

U.S. PATENT DOCUMENTS

| | | | | | |
|---|---|---|---|---|---|
| 2,887,327 | A | | 5/1959 | Tucker | |
| 3,001,690 | A | * | 9/1961 | Paterson | 229/92.8 |
| 3,190,541 | A | | 6/1965 | McLaughlin et al. | |
| 3,351,268 | A | | 11/1967 | Wayne | |
| 3,468,716 | A | | 9/1969 | Eisenberg et al. | |
| 3,915,410 | A | | 10/1975 | Perry et al. | |
| 4,004,689 | A | | 1/1977 | Glasell | |
| 4,433,780 | A | | 2/1984 | Ellis | |
| 4,722,376 | A | | 2/1988 | Rhyner | |
| 4,893,838 | A | * | 1/1990 | Wober | 281/45 |
| 4,936,769 | A | | 6/1990 | Schoenleber | |
| 5,001,853 | A | * | 3/1991 | Odien | 40/312 |
| 5,114,009 | A | | 5/1992 | Johnston | |
| 5,133,496 | A | | 7/1992 | Davidson et al. | |
| 5,143,279 | A | * | 9/1992 | Gaines | 229/68.1 |
| D335,028 | S | | 4/1993 | Berlin | |
| 5,349,769 | A | | 9/1994 | Okola | |
| 5,494,544 | A | | 2/1996 | Hill et al. | |
| 5,760,381 | A | | 6/1998 | Stich et al. | |
| 5,822,897 | A | | 10/1998 | Ertzan | |
| 5,842,629 | A | | 12/1998 | Sprague et al. | |
| 5,862,979 | A | | 1/1999 | Hill et al. | |
| 5,918,394 | A | | 7/1999 | Babcock | |
| 6,148,550 | A | | 11/2000 | Niedfeld | |
| 6,209,924 | B1 | | 4/2001 | Pyle et al. | |
| 2002/0100797 | A1 | | 8/2002 | Hollingsworth et al. | |
| 2003/0047936 | A1 | | 3/2003 | Falcon et al. | |
| 2003/0150142 | A1 | | 8/2003 | Street | |
| 2004/0093773 | A1 | | 5/2004 | Clark | |

OTHER PUBLICATIONS

"Have Fun" Gift Card Holder believed to be publicly distributed before Aug. 29, 2003 (1 page).

"Long Distance Greetings" Pre-paid Phone Card Holder believed to be publicly distributed before Aug. 29, 2003 (1 page).

"Launching Ceremony of Asuka" Card Holder believed to be publicly distributed before Aug. 29, 2003 (3 pages).

* cited by examiner

CARD FOR RETAINING ITEMS THEREIN

CROSS-REFERENCE TO RELATED APPLICATION(S)

This application is a continuation of application Ser. No. 10/653,040, filed on Aug. 29, 2003, now U.S. Pat. No. 7,204,048 the entire contents of which are hereby incorporated by reference.

TECHNICAL FIELD

This document relates to cards, such as greeting cards, capable of retaining items therein.

BACKGROUND OF THE INVENTION

Cards may be used to retain items therein. For example, greeting cards are commonly used to deliver messages to the intended recipients. Such greeting cards may bear messages of sorrow, grief, sympathy, emotions, joy, well wishes, celebration of events, humor, or various other communications. A greeting card may also be used to deliver a gift item to the recipient. For example, a gift item such as paper currency may be inserted into a greeting card, and the card (when in a folded condition) may be delivered to the recipient. After the greeting card is opened, the paper currency is revealed to the recipient. Another example of a gift item that may be included in a greeting card is a transaction card. Such transaction cards are typically similar in size and shape to standard credit cards and may be used, for example, as a gift certificate or a prepaid merchandise credit toward a purchase at a retail establishment.

A traditional greeting card—where one panel is folded over another panel—is not necessarily conducive to retaining gift items such as paper currency or transaction cards. If the folded greeting card is held or manipulated without proper care, the gift item inside the greeting card may unintentionally release from the greeting card, and the gift item may be lost before the recipient is able to receive it.

Some cards, such as greeting cards, are formed with pockets or cut lines in the card, which may be used to retain a gift item in the card. For example, a greeting card may have a pocket or an envelope formed thereon so that a gift item may be held in the card until the recipient receives it. Because a gift item such as paper currency is usually not the same size as a gift item such as a transaction card, separate cards typically are used to deliver different types of gift items. As such, a retail consumer typically decides at the time of purchasing a card whether the intended gift item to be included in the card should be in the form of paper currency or in the form of a transaction card.

SUMMARY OF THE INVENTION

A card may include a generally planar panel and a plurality of opposing retaining members disposed on the panel. The plurality of opposing retaining members may be arranged to retain a substantially rectangular transaction card having a first longitudinal axis in a first orientation with respect to the panel and to retain a substantially rectangular paper gift having a second longitudinal axis in a second orientation with respect to the panel, so that the orientation of the first longitudinal axis is substantially transverse to the second orientation of the second longitudinal axis. The paper gift may be, for example, paper monetary currency, a paper bank check, or a paper gift certificate. The transaction card may be, for example, a debit card, a credit card, a gift card, a prepaid phone card, a card containing a merchandise credit usable at a retail establishment.

A method of using a card comprising a panel and a plurality of opposing retaining members disposed on the panel may include removably retaining a substantially rectangular transaction card by the plurality of opposing retaining members and removably retaining a substantially rectangular paper gift by the plurality of opposing retaining members. The transaction card may have a first longitudinal axis in a first orientation with respect to the panel and the paper gift may have a second longitudinal axis in a second orientation with respect to the panel, wherein the first orientation of the first longitudinal axis is substantially transverse to the second orientation of the second longitudinal axis.

BRIEF DESCRIPTION OF THE DRAWINGS

Like reference symbols in the various drawings indicate like elements.

DETAILED DESCRIPTION OF ILLUSTRATIVE EMBODIMENTS

Figure 3:
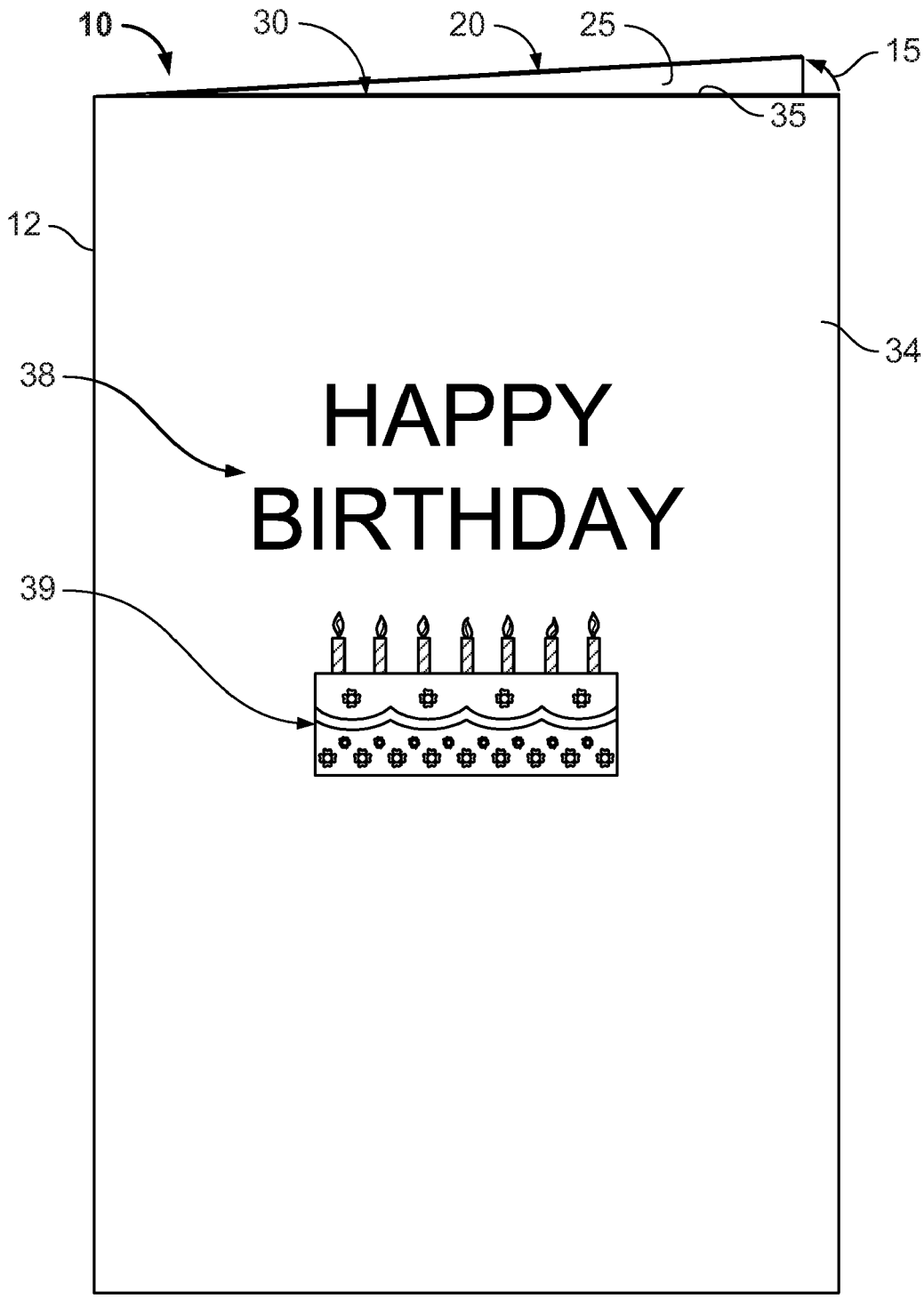
FIG. 3 is a perspective view of a greeting card in accordance with yet another embodiment of the invention.
Figure 4:
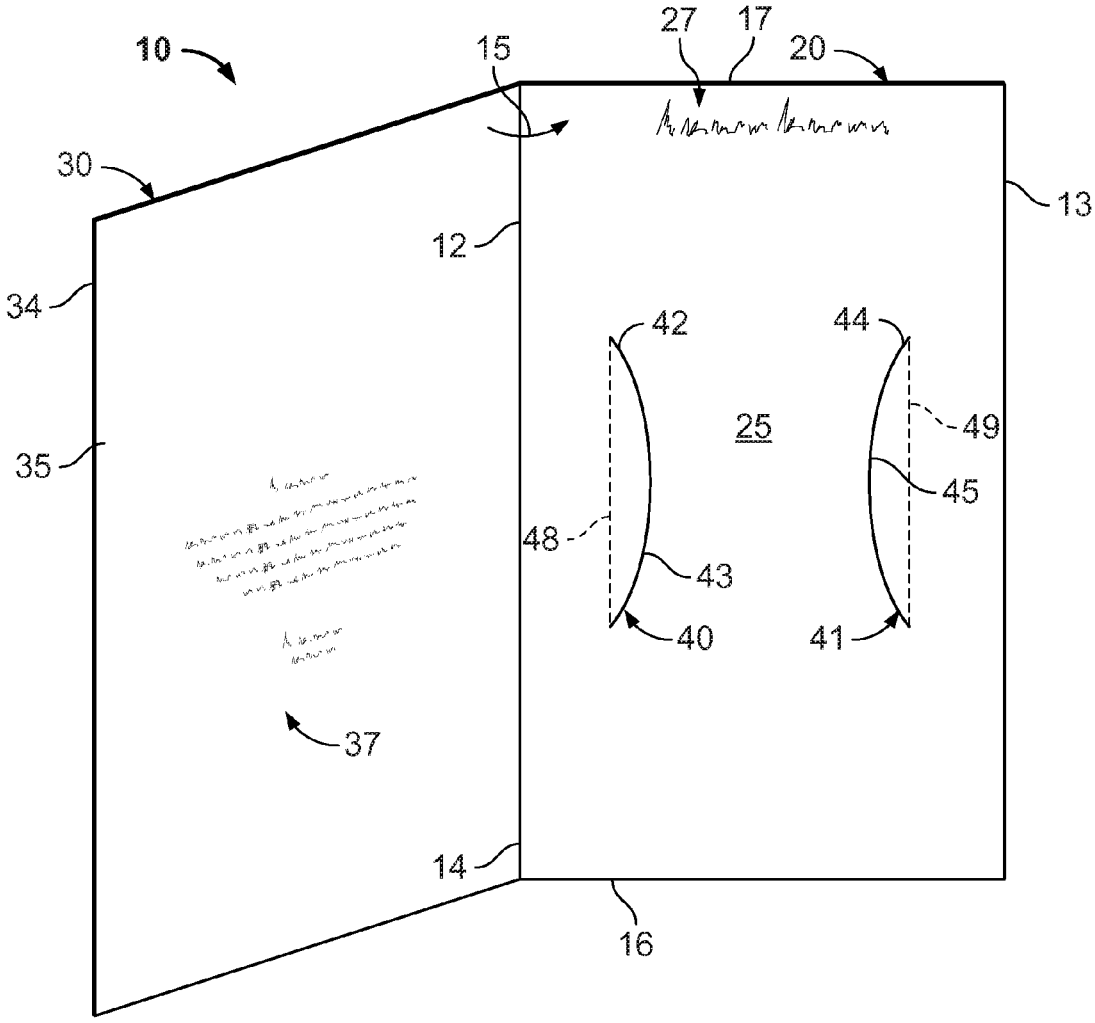
FIG. 4 is a perspective view of the greeting card of FIG. 3, shown in an opened condition.

Referring to FIG. 3, a greeting card 10 includes a generally planar front panel 30 and a generally planar rear panel 20. A fold line 12 couples front panel 30 and rear panel 20 such that greeting card 10 is adjustable between an opened condition (as shown in FIG. 4) and a folded condition (as shown in FIG. 3). Greeting card 10 is adjusted to the folded condition by moving an inside face 35 of front panel 30 in a direction 15 toward an inside face 25 of rear panel 20, or vice versa. In an embodiment, an outside face 34 of front panel 30 may include one or more of a message 38, a FIG. 39, or other printed matter. In other embodiments, one or more of such messages, figures, and/or printed matter may also be included on inside face 35 of front panel 30, inside face 25 of rear panel 20, and/or outside face of rear panel 20 (not shown). Such messages, figures, and printed matter are not limited to the embodiment shown in FIG. 3, but may communicate, for example, sorrow, grief, sympathy, emotions, joy, well wishes, celebration of events, humor, or other expressions.

Referring to FIG. 4, the greeting card 10 is shown in an opened condition such that the inside faces 25 and 35 of the rear and front panels 20 and 30 are revealed. In the embodiment shown in FIG. 4, rear panel 20 is substantially rectangular, defined by substantially parallel long edges 13 and 14 which are substantially perpendicular to and intersect short edges 16 and 17. However, front and rear panels 20 and 30 may have any other suitable shape such as square, oval, circular, or triangular. As depicted, long edges 13 and 14 are substantially parallel to fold line 12. However, long edges 13 and 14 can be at any other orientation, such as transverse, to fold line 12. While both a front panel and a rear panel are depicted, greeting card 10 need only contain one panel, such as rear panel 20 or front panel 30.

Opposing retaining members 40 and 41 are disposed on rear panel 20. As shown in FIG. 4, retaining members 40 and 41 are in the form of opposing flaps 40 and 41 formed from convex die cuts 42 and 44 in rear panel 20. However, retaining member 40 and 41 may have other forms, such as tabs, apertures, or die cuts. Flaps 40 and 41 are coupled to rear panel 20 by substantially parallel flap lines 48 and 49, respectively. As shown in FIG. 4, flap lines 48 and 49 are substantially parallel to fold line 12. In other embodiments, flap lines 48 and 49 may be at other orientations, such as transverse, with respect to fold line 12. As shown in FIG. 4, flap 40 has an arc shape with a convex edge 43 that faces and protrudes toward convex edge 45 of opposing arc-shaped flap 41. However, the invention is not limited to the depicted embodiment, and the flaps 40 and 41 may be formed in other shapes, such as triangles, rectangles, or trapezoids.

Figure 5:
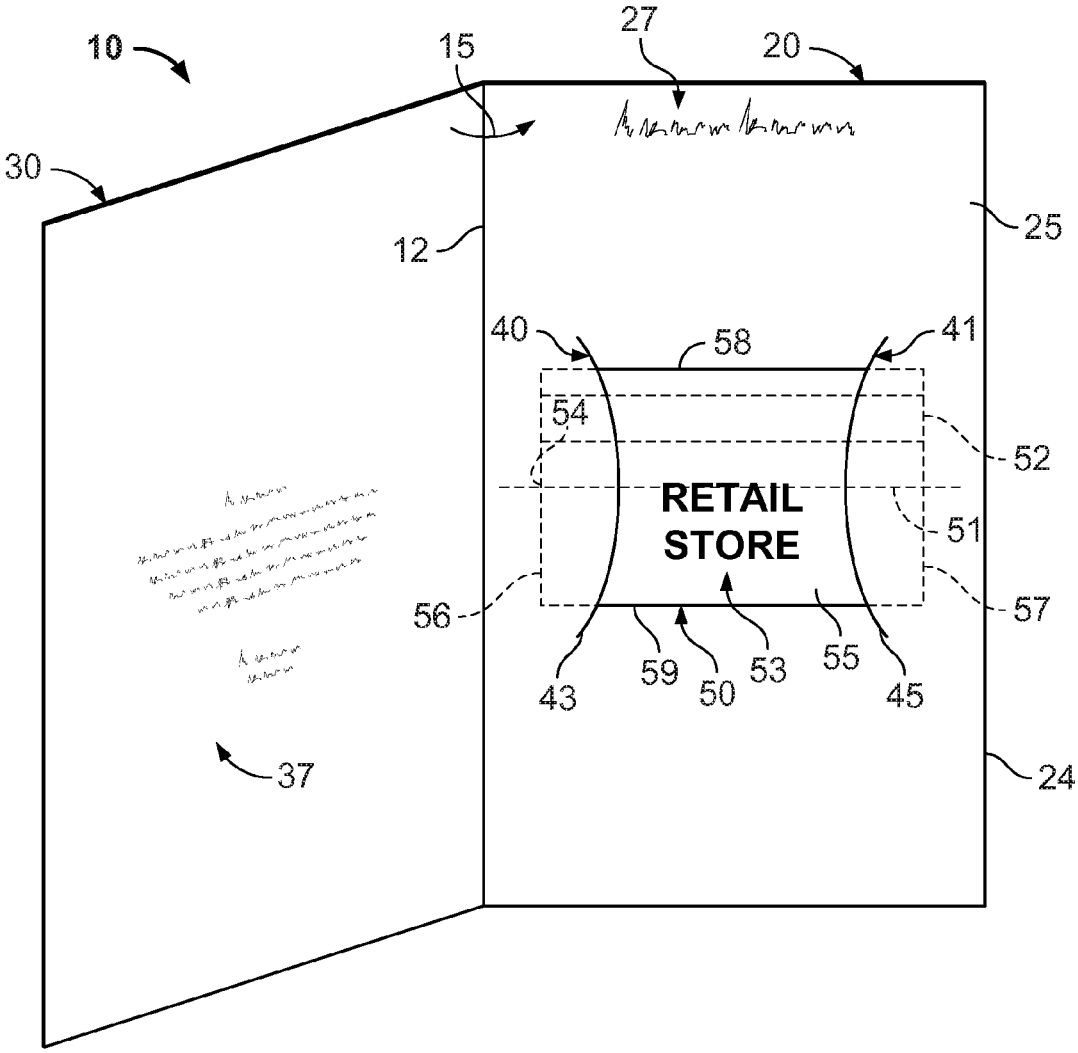
FIG. 5 is a perspective view of the greeting card of FIG. 4 having a transaction card retained therein.

Referring to FIG. 5, greeting card 10 is adapted to receive a transaction card 50. Transaction card 50 may be a plastic substrate having a substantially rectangular shape similar to that of a standard credit card. In the embodiment shown in FIG. 5, transaction card 50 has a substantially rectangular shape defined by opposing major edges 58 and 59 that intersect with opposing minor edges 56 and 57, where each major edge is greater in length than the minor edge. As shown in FIG. 5, transaction card 50 has a longitudinal axis 51 substantially parallel to major edges 58 and 59.

Transaction card 50 may be releasably retained by opposing retaining members 40 and 41 so that a portion of transaction card 50 is exposed when greeting card 10 is adjusted to an opened condition (as shown in FIG. 5). As shown in FIG. 3, transaction card 50 is retained in a first orientation wherein longitudinal axis 51 is substantially transverse to flap lines 48 and 49, to fold line 12 and to long edges 13 and 14. In other embodiments, transaction card 50 may be retained in other orientations, such as where longitudinal axis 51 is parallel to flap lines 48 and 49, fold line 12, and/or long edges 13 and 14.

When transaction card 50 is being retained, minor edges 56 and 57 of the transaction card 50 are covered by opposing flaps 40 and 41 while a portion of major edges 58 and 59 extend between the flaps 40 and 41. Optionally, a magnetic strip 52 is included on the rear face 54 of the transaction card 50, which stores data associated with the transaction card 50. The transaction card 50 may be, for example, a debit card, a credit card, a gift card, a prepaid phone card, a card containing a merchandise credit usable at a retail establishment, or another similar device. The front face 55 of the transaction card 50 may include a logo or other phrase 53 that identifies the particular establishment at which the transaction card is redeemable. In such cases, the opposing flaps 40 and 41 may be positioned such that logo or phrase 53 is exposed to the recipient when the greeting card 10 is opened.

Figure 6:
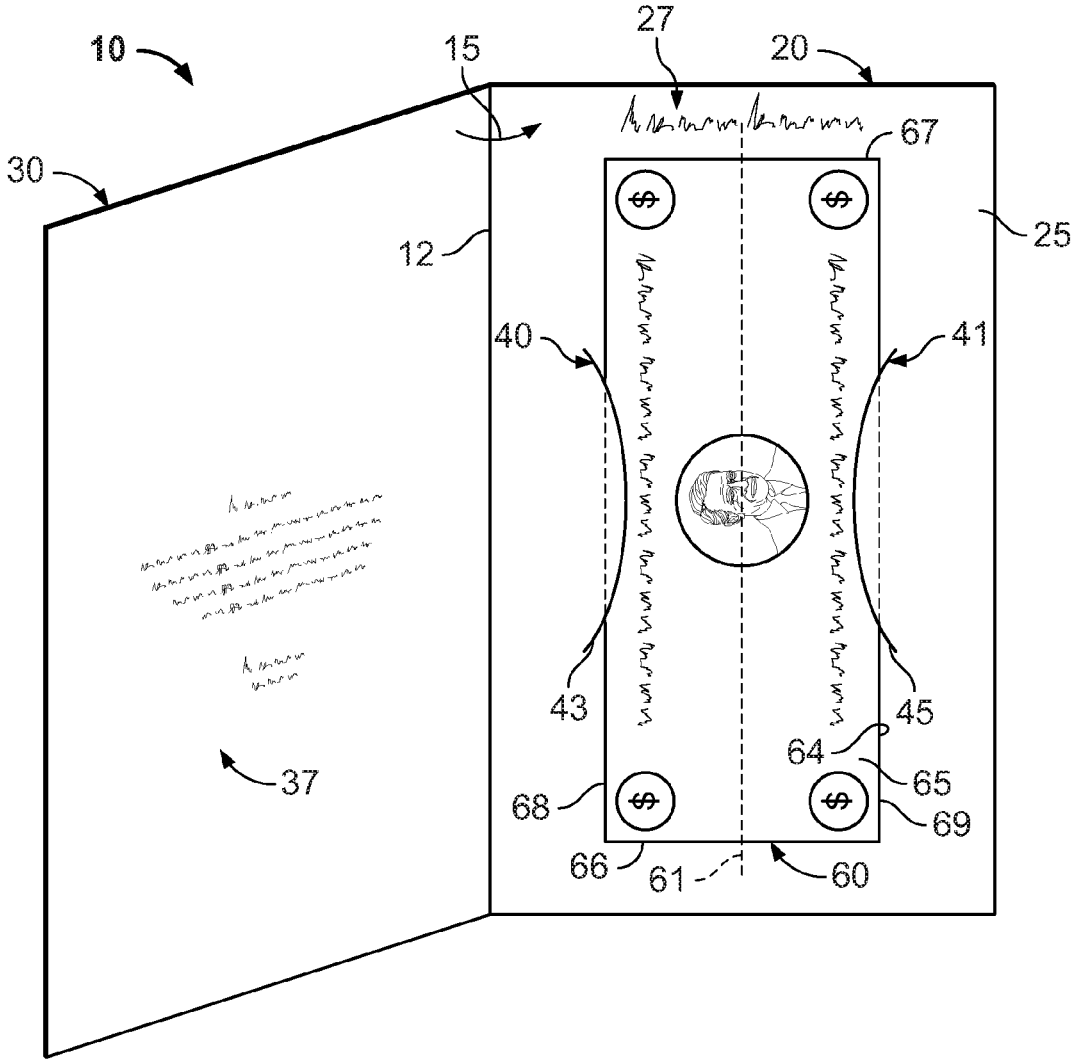
FIG. 6 is a perspective view of the greeting card of FIG. 4 having monetary currency retained therein.

Referring to FIG. 6, greeting card 10 is also adapted to receive a substantially rectangular paper gift, such as paper monetary currency 60, a paper bank check, a paper gift certificate, or a paper coupon. Paper currency 60 is releasably retained by opposing flaps 40 and 41 so that a portion of paper currency 60 is exposed when the greeting card 10 is moved to an opened condition (as shown in FIG. 6). In the embodiment shown in FIG. 6, paper currency 60 includes opposing major edges 68 and 69 that intersect with opposing minor edges 66 and 67, where each major edge is greater in length than the minor edge. Paper currency 60 has a longitudinal axis 61 substantially parallel to major edges 68 and 69.

In the embodiment shown in FIG. 6, paper currency 60 is retained in a second orientation wherein longitudinal axis 61 is substantially parallel to flap lines 48 and 49, to fold line 12, and to long edges 13 and 14. In other embodiments, paper currency 60 may be retained in other orientations, such as where longitudinal axis is positioned transverse to flap lines 48 and 49, to fold line 12, and/or to long edges 13 and 14. A portion of the major edges 68 and 69 are covered by the opposing flaps 40 and 41. The minor edges 66 and 67 of the currency 60 are not covered by the flaps 40 and 41 and rest on the inside face 25 of the rear panel 20 of the greeting card 10.

As shown in FIGS. 3 and 4, greeting card 10 is capable of retaining transaction card 50 in a first orientation (see FIG. 5) with respect to rear panel 20 and is also capable of retaining paper currency 60 in a second orientation (see FIG. 6) with respect to rear panel 20. In comparing the two orientations, longitudinal axis 51 of transaction card 50 is transverse to longitudinal axis 61 of paper currency 60. Advantageously, greeting card 10, having a single pair of opposing flaps 40 and 41, may be operated to retain a transaction card 50 or to retain monetary currency 60 without the need for redundant or multiple sets of flaps (e.g., one set of flaps to retain a transaction card and a separate set of flaps to retain monetary currency). Furthermore, a user may obtain the greeting card 10 and decide at a later time whether a transaction card 50 or monetary currency should be included as a gift item in the greeting card 10.

In an embodiment, major edges 58 and 59 of transaction card 50 are shorter in length than major edges 68 and 69 of paper currency 60 and longer in length than minor edges 66 and 67 of paper currency 60. In addition, minor edges 56 and 57 of transaction card 50 may be shorter in length than minor edges 66 and 67 and major edges 68 and 69 of paper currency 60. For example, major edges 58 and 59 of transaction card 50 may measure approximately 3.375 inches in length and minor edges 56 and 57 of transaction card 50 may measure approximately 2.125 inches in length. Meanwhile, major edges 68 and 69 of paper currency 60 can have a length of approximately 6.0 to 6.5 inches and minor edges 66 and 67 of paper currency can have a length of approximately 2.5 to 3.0 inches. Despite these size differences between transaction card 50 and paper currency 60, retaining members 40 and 41 can be advantageously configured to retain either transaction card 50 or paper currency 60 without the need for redundant retaining members.

In operation, flaps 40 and 41 work in conjunction with panels 20 or 30 of the greeting card 10 in which the cut lines 42 and 44 are formed. Referring to the embodiments shown in FIGS. 3 and 4, the cut lines 42 and 44 are made in rear panel 20 of the greeting card 10 so as to form the flaps 40 and 41. Alternatively, the cut lines 42 and 44 may be made in the front panel 30 of the greeting card 10 so that the flaps 40 and 41 work in conjunction with the front panel 30 to retain the transaction card 50 or the monetary currency 60.

Referring to FIG. 5, the greeting card 10 may be operated to retain the transaction card 50 by inserting the minor edge 56 of the transaction card between flap 40 and inside face 25. Transaction card 10 is then maneuvered so that the other minor edge 57 is then inserted between the flap 41 and the inside face 25. Alternatively, transaction card 50 may be received in greeting card 10 by first inserting the minor edge 57 and subsequently inserting the other minor edge 56. In another embodiment, transaction card 50 may be inserted by placing transaction card 50 behind outside face of rear panel 25 and then inserting minor edge 54 through cut line 44 in rear panel 25 formed by convex edge 45 of flap 41. Transaction card 50 can then be slid through to partially cover inside face 25 and minor edge 54 can be slid through cut line 42 and behind flap 40. When the transaction card 50 is retained in the orientation in accordance with the embodiment shown in FIG. 5, inside face 25 abuts the rear face 54 of the transaction card 50 while the flaps 40 and 41 abut the front face 55 of the transaction card 50.

Referring to FIG. 6, greeting card 10 may be operated to retain paper currency 60 by inserting a portion of major edge 68 between flap 40 and inside face 25. Paper currency 60 may be flexed or manipulated so that a portion of other major edge 69 is inserted between the flap 41 and inside face 25. When paper currency 60 is retained in greeting card 10 in accordance with the embodiment shown in FIG. 6, inside face 25 abuts one face 64 of the currency 60 while flaps 40 and 41 abut opposing face 65 of the currency 60. In other embodiments, other paper gifts, such as paper bank checks and paper gift certificates, may be similarly retained by flaps 40 and 41.

Figure 1:
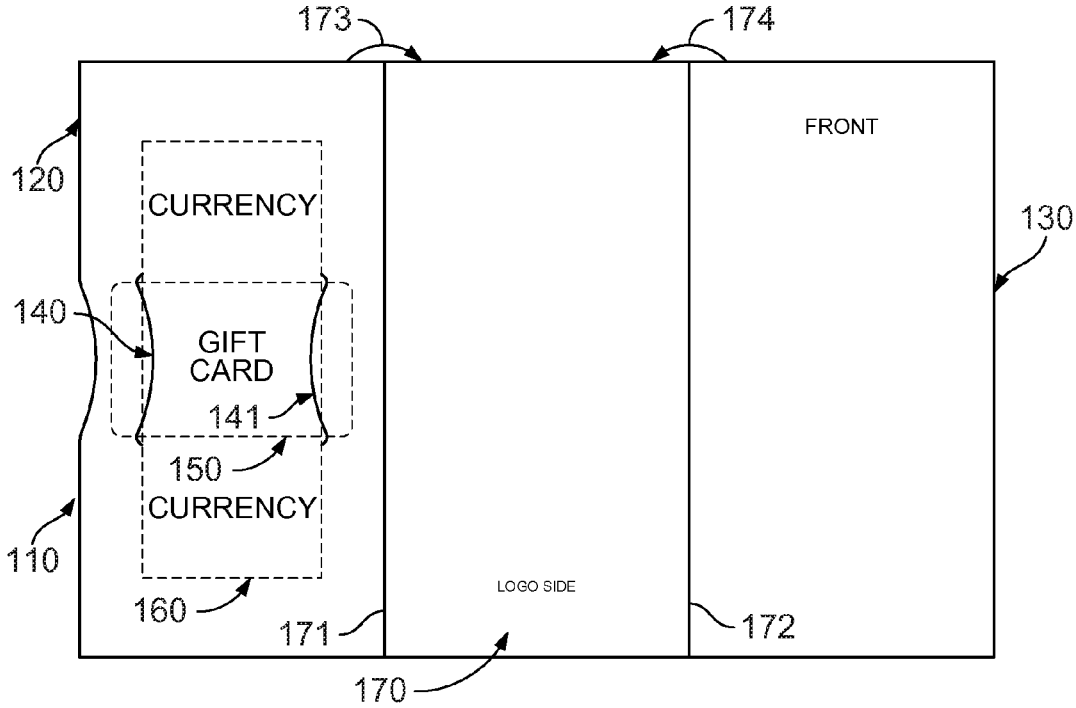
FIG. 1 is a plan view of a greeting card in accordance with an embodiment of the invention.

FIG. 1 shows another embodiment of greeting card 110. Greeting card 110 has retaining members 140 and 141 configured to retain transaction card 150 and/or paper gift 160 in the same manner and orientation as retaining members 40 and 41 of rear panel 20. The embodiment depicted in FIG. 1 is different from the embodiment depicted in FIGS. 3-6 in that retaining members 140 and 141 are disposed on a middle panel 120. Middle panel 120 is coupled to a rear panel 170 by a middle-rear panel fold edge 171. Rear panel 170 is in turn coupled to a front panel 130 by a front-rear panel fold edge 172. Middle panel 120 is moveable along arrow 173 to be folded over rear panel 170. Front panel 130 is then moveable along arrow 174 to be folded over middle panel 120 such that middle panel 120 is sandwiched between front panel 130 and rear panel 170. Thus, card 110 is moveable between a closed condition in which middle panel 120 is hidden by front panel 130 and by rear panel 170 and an open condition in which the front panel opens to reveal middle panel 130.

Figure 2:
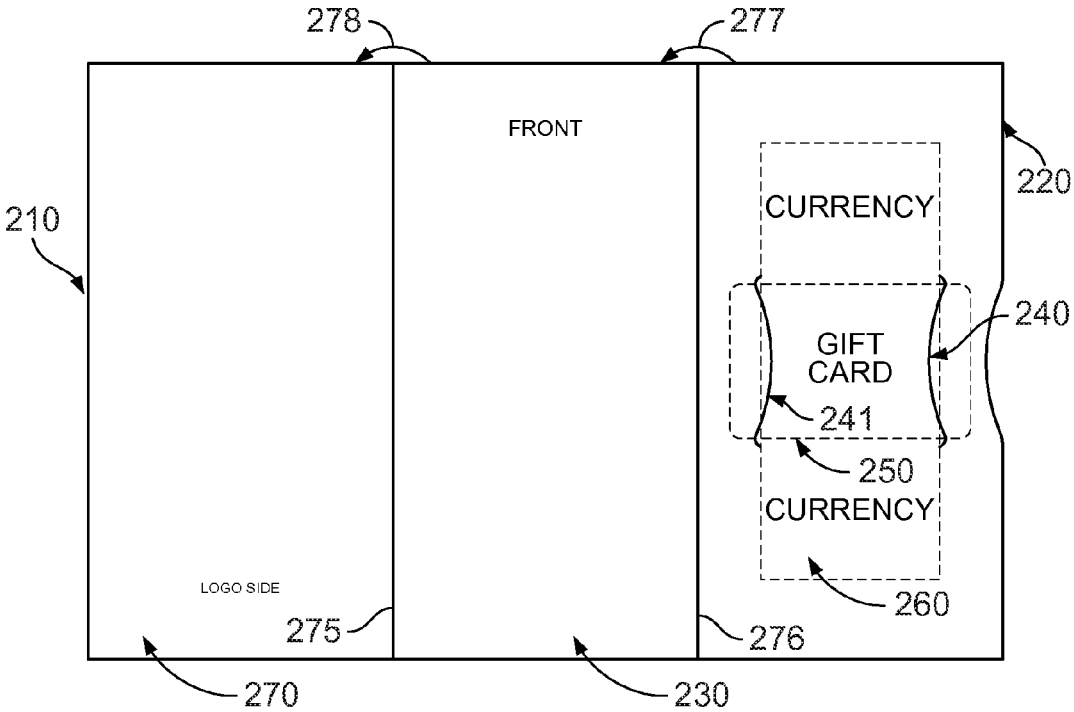
FIG. 2 is a plan view of a greeting card in accordance with another embodiment of the invention.

FIG. 2 shows yet another embodiment of greeting card 110. Greeting card 110 has retaining members 240 and 241 configured to retain transaction card 250 and/or paper gift 260 in the same manner and orientation as retaining members 40 and 41 of rear panel 20. The embodiment depicted in FIG. 2 is different from the embodiment depicted in FIGS. 3-6 in that retaining members 240 and 241 are disposed in a middle panel 220. Middle panel 220 is coupled to a front panel 230 by a front-middle fold edge 276. Front panel 230 is in turn coupled to a rear panel 270 by a front-rear panel fold edge 275. Middle panel 220 is moveable along arrow 277 to be folded behind front panel 230. Front panel 230 is then moveable along arrow 278 to be folded over rear panel 270 such that middle panel 220 is sandwiched between front panel 230 and rear panel 270. Thus, card 210 is moveable between a closed condition in which middle panel 220 is hidden by front panel 230 and by rear panel 270 and an open condition in which the front panel opens to reveal middle panel 230.

A number of embodiments of the invention have been described. Nevertheless, it will be understood that various modifications may be made without departing from the spirit and scope of the invention. For example, the greeting card may have a design other than a vertical fold line with front and rear panels. Instead, the greeting card may have a horizontal fold line, multiple fold lines, or no fold lines. Moreover one or more faces of the greeting card may be blank so that the user may write personalized message. In addition, the flaps may have a shape other than an convex arc shape. For instance, the cut lines may have one or more corners so that the flaps have a triangular, rectangular, or trapezoidal shape. Furthermore, the greeting card may be capable of simultaneously retaining more than one gift item at a time. As such, the greeting card may be operated to retain both a transaction card and a paper gift at the same time. Accordingly, other embodiments are within the scope of the following claims.

What is claimed is:

1. A greeting card for retaining a substantially rectangular transaction card or paper currency, the card comprising:

a panel having a perimeter, a width greater than 3 ⅜ inches, and a length greater than 6 ½ inches; and a single pair of opposing tabs disposed on said panel to releasably secure the transaction card in a substantially stationary position or to releasably secure the paper currency in a substantially stationary position, the single pair of opposing tabs being spaced in from said perimeter of the panel;

wherein when the transaction card is releasably secured to the panel by the single pair of opposing tabs, the transaction card is arranged in contact with both of the opposing tabs and in a first orientation relative to the panel, and wherein when the paper currency is releasably secured to the panel by the single pair of opposing tabs, the paper currency is arranged in contact with both of the opposing tabs and in a second orientation relative to the panel that is substantially transverse to the first orientation.

2. The greeting card of claim 1, wherein the panel is a rear panel and the greeting card further comprises a front panel coupled to the rear panel so that the front panel and the rear panel are moveable between a closed condition and an open condition.

3. The greeting card of claim 1, wherein each of the opposing tabs is curved.

4. The greeting card of claim 1:

wherein the paper currency has a major longitudinal axis and the transaction card has a major longitudinal axis, wherein when the transaction card is releasably secured to the panel by the single pair of opposing tabs, the major longitudinal axis of the transaction card is arranged generally parallel to the width of the panel, and wherein when the paper currency is releasably secured to the panel by the single pair of opposing tabs, the major longitudinal axis of the paper currency is arranged generally parallel to the length of the panel.

5. The greeting card of claim 1, wherein the panel comprises a front face and a rear face, and wherein when the transaction card is releasably secured to the panel by the single pair of opposing tabs, a substantial portion of the transaction card extends through openings in the panel and rearward of the rear face.

6. The greeting card of claim 1, wherein each of the single pair of opposing tabs define an opening through the panel.

7. The greeting card of claim 6, wherein each of the opposing tabs is die-cut into the panel to define the opening in the panel.

8. The greeting card of claim 1, wherein the paper gift item is selected from the group consisting of paper monetary currency, a paper bank check, or a paper gift certificate, and wherein the transaction card is selected from the group consisting of a debit card, a gift card, a prepaid phone card, and a card containing a merchandise credit.

* * * * *